US006688509B2

(12) United States Patent
Orikasa et al.

(10) Patent No.: US 6,688,509 B2
(45) Date of Patent: Feb. 10, 2004

(54) CONNECTION FILAMENT INSERTING APPARATUS

(75) Inventors: Yosuke Orikasa, Tohgane (JP); Fusaji Mimura, Tohgane (JP); Naokazu Tsuchiya, Tohgane (JP); Kiyoaki Saito, Tohgane (JP)

(73) Assignee: Ryokosha Co., Ltd., Tokyo (JP)

( * ) Notice: Subject to any disclaimer, the term of this patent is extended or adjusted under 35 U.S.C. 154(b) by 0 days.

(21) Appl. No.: 10/217,437

(22) Filed: Aug. 14, 2002

(65) Prior Publication Data

US 2003/0057249 A1 Mar. 27, 2003

(30) Foreign Application Priority Data

Sep. 21, 2001 (JP) ..... 2001-329968

(51) Int. Cl.[7] ..... B25C 1/00

(52) U.S. Cl. ..... 227/67; 227/70; 227/71; 227/31; 227/32; 227/37; 24/704.1; 24/704.2

(58) Field of Search ..... 227/67, 70–71, 227/31, 32, 37; 24/704.1, 704.2

(56) References Cited

U.S. PATENT DOCUMENTS

| | | | | | |
|---|---|---|---|---|---|
| 3,470,834 | A | * | 10/1969 | Bone | 227/67 |
| 4,455,858 | A | * | 6/1984 | Hettich | 227/67 |
| 4,844,318 | A | * | 7/1989 | Kunreuther | 227/67 |
| 5,489,057 | A | * | 2/1996 | Deschenes | 227/67 |
| 5,924,620 | A | | 7/1999 | Orikasa et al. | |
| 6,491,200 | B1 | * | 12/2002 | McCarthy | 227/67 |

* cited by examiner

*Primary Examiner*—Rinaldi I. Rada
*Assistant Examiner*—Michelle López
(74) *Attorney, Agent, or Firm*—Oblon, Spivak, McClelland, Maier & Neustadt, P.C.

(57) ABSTRACT

A connection filament inserting apparatus of the present invention is for inserting a T-shape portion of a connection filament through an article safety and speedy, and comprises a hollow body formed by plastic working, said hollow body having a conical formed front end and an opening formed at a front end, where a length of the opening is longer than a prior art. It can be prevent that the accidents happen, such as a T-shape portion of a connection filament is pushed in or caught in a cavity of a front end of a conical portion.

5 Claims, 4 Drawing Sheets

Ejecting

CONNECTION FILAMENT INSERTING APPARATUS

BACKGROUND OF THE INVENTION

The present invention relates to a connection filament inserting apparatus for inserting a T-shape connection filament made with nylon through a clothes or the like in order to attach a tag with the connection filament to the clothes.

As the connection filament inserting apparatus A of the prior art, the product disclosed in Japanese Patent Second Publication No. Sho 57-37506 shown in FIG. 7, has been used in general.

When the used example of this apparatus is explained with FIG. 7, the connection filament inserting apparatus A for attaching the connection filament is used by the following process. That is, the T-shape connection filament 1 made with nylon for attaching the tag etc. thorough the clothes is used, and the T-shape portion 2 of said connection filament 1 is inserted in the apparatus A having hollow body. While being this state, the apparatus A is inserted thorough the clothes to push out the T-shape portion 2 of the connection filament 1 from the backside of said body. After that, when the apparatus A is pulled out from the clothes, the T-shape portion 2 of said connection filament 1 stands up to prevent the movement so that the connection filament 1 is attached to the clothes.

Moreover, the production process of the connection filament inserting apparatus A is the followings. That is, the hollow body is formed from the metal plate 4 for inserting the T-shape portion 2 of said connection filament 1, the inner space 5 being formed on the top connecting surface of said hollow body for accommodating the connection filament 1, the tip 6 being formed and pointed in the shape like a spoon shown in FIG. 7 in order to pierce easily through a fiber, such as the clothes, and the piercing portion 8 being shaved to be depressed at the center from the opening 7 to the front end of said hollow body.

In the case of this connection filament inserting apparatus A, when the connection filament 1 made with nylon is attached to the clothes, said filament 1 can be attached speedy and easily since the front end is formed in the shape of the spoon. However, there are many problems as followings.

As one of the main problems, since the tip 6 is formed sharply with a metal plate 4, when the tip 6 is pierced into the clothes, the sharp edges 9 at both sides of said tip 6 may cut the thread of the fibers of the clothes in a manner similar to a knife, so that said clothes may be damaged.

Furthermore, when the connection filament inserting apparatus A pierces the clothes, the inserting resistance per unit area at the tip 6 increases as approaching to the front end, and the sectional size of the opening 7 decreases as approaching the front end. So, the bending strength to the inserting resistance becomes small, and the tip 6 may be accidentally broken by bending. Therefore, said connection filament inserting apparatus A cannot be used for products, through which it is difficult to pass the inserting, such as a stiff cloth, a carpet, and leather goods.

Moreover, there are many other problems. That is, if the tip 6 can be formed to the ideal form in the producing process, since the tip 6 has less strength, the front end begins to be bent from immediately after use to occur the deformation of the opening 7, so that the inserting resistance is varied sharply to occur the breaking accident. Furthermore, since the tip 6 is formed very sharply, said tip 6 pierces easily and deeply in a worker's hand or body at the time of said breaking accident, and there is a danger that the broken fragment may remain in a worker's body. Therefore, it is not preferable on the cure against the Product Liability Law.

So, the inventor has provided the connection filament inserting apparatus B, that is, the product disclosed in Japanese Patent Raid Open No. 10-91072. Regarding this invented apparatus B, the filler 10, such as an elastic metal or plastic, is filled in the cavity 19 of the front end 11 of the conical portion to push out speedy the connection filament 1 from the opening 16. After that, the surface finishing of the metal of the periphery section of the hollow portion and the near opening excepting of the axial portion of said apparatus, is done by polishing or grinding in order to make fine appearance. However, the exothermal reaction occurs at the time of the polishing or grinding to concentrate heat on the front end 11, so that the accident, where the filled filler 10 is melted, occurs. Therefore, there has the annoyance that the filler 10 in the cavity 19 of the front end 11 must be filled again. Then, in order to solve said annoyance of re-filling, the connection filament inserting apparatus B, where the filling process of the filler 10, such as metal or plastic, is stopped, has been used. However, regarding said apparatus B, since the length of said opening 16 is short and the filler 10 guiding the T-shape portion 2 of said connection filament 1 is removed, as shown in FIG. 9, the T-shape portion 2 of the connection filament 1 pushed out from the backside, may be easily pushed or caught in the cavity 19, so that said T-shaped portion 2 cannot be came out from the opening 16. Therefore, there has also the annoyance that the removal processing is necessary.

SUMMARY OF THE INVENTION

The present invention solves said problems of the prior art, and provides the connection filament inserting apparatus, which can attach the connection filament 1 safety and speedy to the article, such as the clothes. In addition, said apparatus has also high strength, and can be used with the connection filament 1 having any form.

In order to accomplish said object, the connection filament inserting apparatus of the present invention comprises the following characteristics.

1. A connection filament inserting apparatus for inserting a connection filament 1 thorough an article, comprising:

a hollow body having a front end 11, a rear end, and an inner space 18 for accommodating said connection filament 1, said hollow body being formed from a metal plate 4, said rear end having an axial portion, a pointed conical portion being formed at said front end 11 by pressing, and an opening 16 for releasing said connection filament 1 from said inner space 18 of said body being formed at said pointed conical portion, wherein a length L between a standard position at said rear end of said axial portion and a rear end of said ellipse opening 16 formed at said front end 11 of said pointed conical portion, is formed about equivalent or a little longer than a length $L_3$ of said connection filament 1, a length $L_1$ of said ellipse opening 16 is formed in the range of $L_1=L_2+2$ mm to 10 mm, where $L_2$ is the length of said T-shape portion 2 when said T-shape portion 2 reaches at said opening 16 by inserting in said hollow body to be pushed out, and said hollow body itself is formed smoothly connecting with a curve of said front end 11 of said pointed conical portion, with forming a hollow body drawing a parabola line gradually narrowed from a near portion of said rear end of said opening 16 to said front end 11.

2. A connection filament inserting apparatus for inserting a connection filament 1 thorough an article, comprising:
a hollow body having a front end 11, a rear end, and an inner space 18 for accommodating said connection filament 1, said hollow body being formed from a metal plate 4, said rear end having an axial portion, a pointed conical portion being formed at said front end 11 by pressing, and an opening 16 for releasing a T-shape portion 2 of said connection filament 1 from said inner space 18 of said body being formed at said pointed conical portion,
wherein a length L between a standard position at said rear end of said axial portion and the rear end of said ellipse opening 16 formed at said front end 11 of said pointed conical portion, is formed about equivalent or a little longer than a length $L_3$ of said connection filament 1, a length $L_1$ of said conical opening 16 is formed in the range of $L_1=L_2+2$ mm to 10 mm, where $L_2$ is the length of said T-shape portion 2 when said T-shape portion 2 reaches at said opening 16 by inserting in said hollow body to be pushed out, and the front portion of said hollow body itself is formed smoothly connecting with a curve of said front end 11 of said pointed conical portion with forming a conical hollow body gradually narrowing from a near portion of the rear end of said opening 16 to said front end.

3. A connection filament inserting apparatus for inserting a connection filament 1 thorough an article, comprising:
a hollow body having a front end 11, a rear end, and an inner space 18 for accommodating said connection filament 1, said hollow body being formed from a metal plate 4, said rear end having an axial portion, a pointed conical portion being formed at said front end 11 by pressing, and an opening 16 for releasing a T-shape portion 2 of said connection filament 1 from said inner space 18 of said body being formed at said pointed conical portion,
wherein a length L between a standard position at said rear end of said axial portion and a rear end of said conical opening 16 formed at said front end 11 of said pointed conical portion, is formed about equivalent or a little long to a length $L_3$ of said connection filament 1, a length $L_1$ of said conical opening 16 is formed in the range of $L_1=L_2+2$ mm to 10 mm, where $L_2$ is the length of said T-shape portion 2 when said T-shape portion 2 reaches at said opening 16 by inserting in said hollow body to be pushed out, and said hollow body itself is formed with an inclined plane at the bottom 20 of said opening 16, by bending into a dogleg or drawing a gradual line from a near portion of said rear end of said opening 16 to said front end 11.

4. A connection filament inserting apparatus for inserting a connection filament 1 thorough an article,
wherein the inclining angle θ from the near portion of said rear end of said opening 16 to the front end 11 is in the range of 1° to 15°.

5. A connection filament inserting apparatus for inserting a connection filament 1 thorough an article,
wherein the metal surface of said apparatus excepting of the axial portion is surface treated by physical or chemical processes.

BRIEF DESCRYPTION OF THE DRAWINGS

DETAILED DESCRYPTION OF THE PREFERRED EMBODIMENTS

Figure 10:
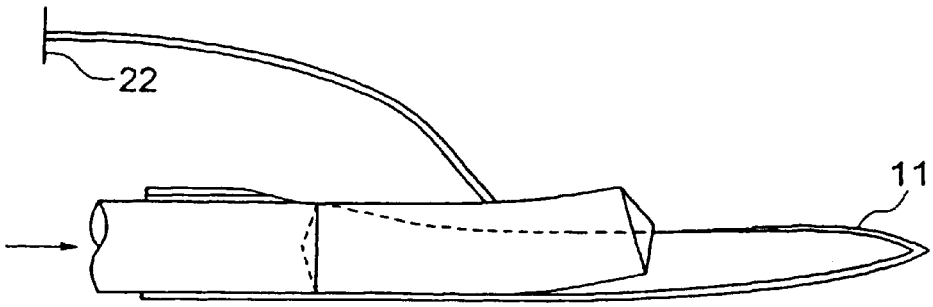
FIG. 10 is an explanatory drawing, where a T-shape portion of a connection filament reaches to the front end of the opening position of the present invention.
Figure 11:
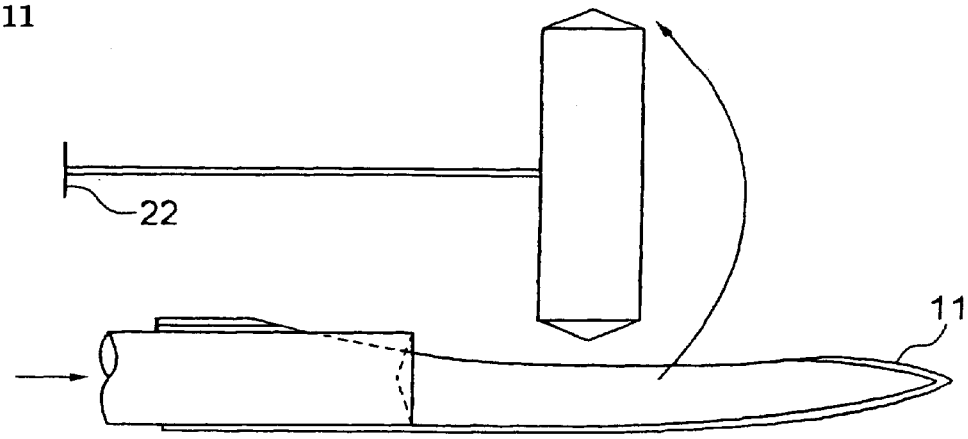
FIG. 11 is an explanatory drawing, where a T-shape portion of a connection filament is pushed out from the opening of the present invention.

The connection filament inserting apparatus of the present invention has the following characteristics and advantages. The hollow body and the front end 11 of the pointed conical portion are formed by a plastic working, and the filler 10 is not filled in the cavity 19 of the front end 11 of the conical portion. Therefore, it becomes possible to do the surface finishing process, such as the polishing or grinding process, which induces the exothermal at the periphery portion or the opening of said hollow body, or the physical and chemical surface treatment. In addition, the length L between the standard position at the rear end of the axial portion and the rear end of the ellipse opening 16 formed at said front end 11 of the pointed conical portion is formed about equivalent or a little longer than the length $L_3$ of said connection filament 1, and the length $L_1$ of said ellipse opening 16 is formed in the range of $L_1=L_2+2$ mm to 10 mm, where $L_2$ is the length of the T-shape portion 2. Moreover, the hollow body is formed to connect smoothly to the curve of the conical front end 11, with a parabolic curve narrowing from the near portion of rear end of said opening 16 to the conical front end 11, or the conical hollow body gradually narrowing to the conical front end 11. Or the hollow body is formed with the inclined plane formed at the bottom 20 of the opening 16 by bending into a dogleg or to draw smooth curve at the near portion of the rear end of the opening 16. Therefore, the strength of the front end 11 is high, and the inserting resistance at the tip is small, so that the fiber of the inserted article, such as the clothes, is not damaged, and there are no accidents, where the T-shape portion 2 of the connection filament 1 is pushed in or caught in the cavity 19. These advantages are shown in FIGS. 10 and 11. Furthermore, since the inclined plane is formed between the near opening 16 and the conical front end 11, when the T-shape portion 2 of the connection filament 1 reaches at the position of the opening 16, the tip of the T-shape portion 2 of the connection filament 1 supports the jumping force to go out from the hollow body more. Therefore, the T-shape portion 2 of the connection filament 1 can be attached speedily and certainly to the article.

Figure 1:
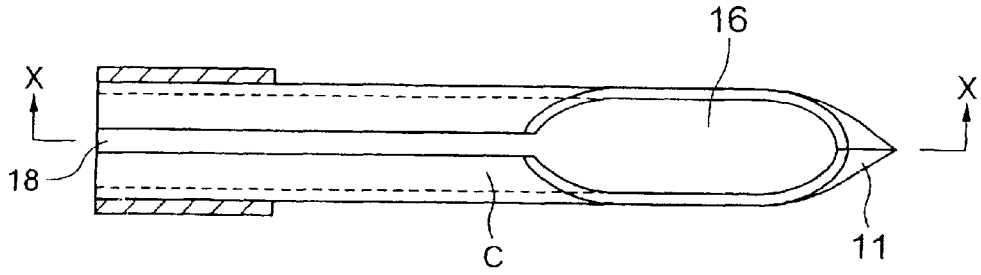
FIG. 1 shows an upper view of a connection filament inserting apparatus of the present invention.
Figure 2:
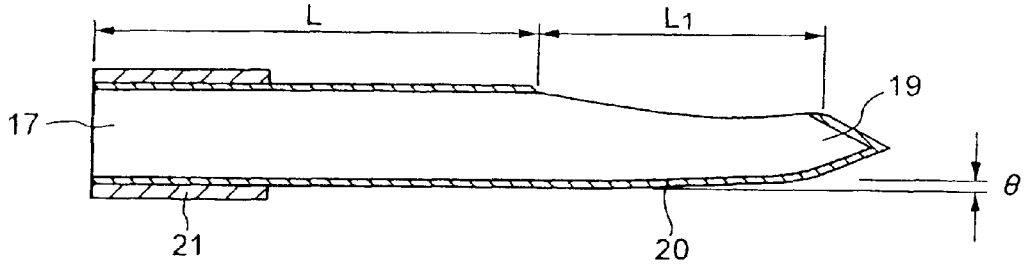
FIG. 2 is a cross section along the line X—X in FIG. 1
Figure 3:
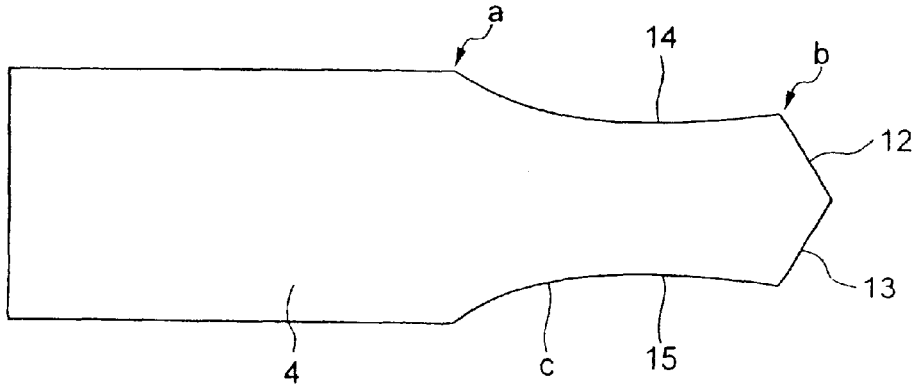
FIG. 3 is a metal plate as a material for the body of the connection filament inserting apparatus of the present invention before machining.
Figure 4:
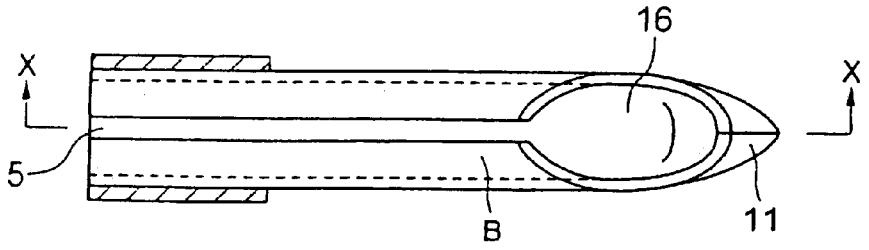
PRIOR ART FIG. 4
FIG. 4 is an upper view of a connection filament inserting apparatus of the prior art.
Figure 5:
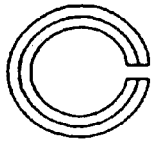
FIG. 5 PRIOR ART
FIG. 5 is a rear view of a connection filament inserting apparatus in FIG. 4.
Figure 6:
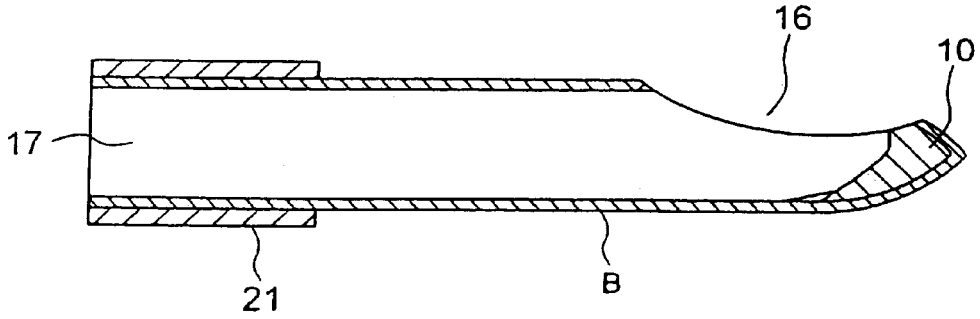
FIG. 6 PRIOR ART
FIG. 6 is a side cross section along the line X—X in FIG. 4.
Figure 7:
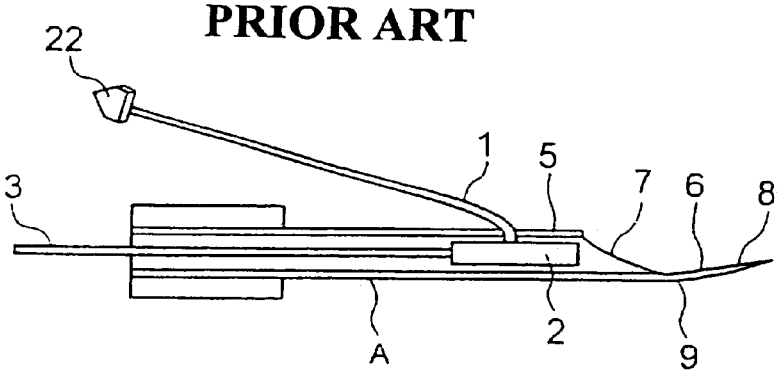
FIG. 7 PRIOR ART
FIG. 7 is a side cross section of a connection filament inserting apparatus of the prior art for explaining.
Figure 8:
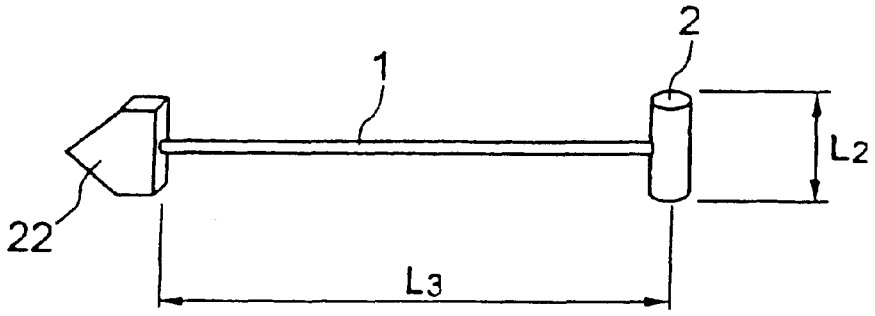
FIG. 8 is an explanatory drawing of a connection filament having a T-shape portion.
Figure 9:
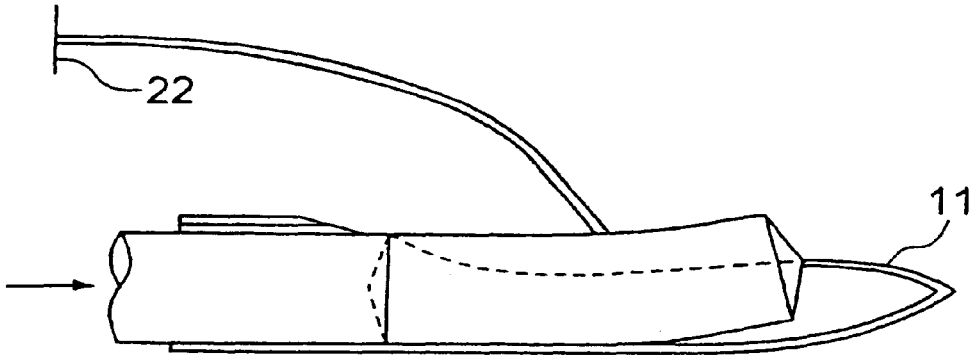
PRIOR ART FIG. 9
FIG. 9 is an explanatory drawing, where a T-shape portion of a connection filament runs to the front end of the opening of the prior art.

Hereafter, the present invention is explained more concretely. FIG. 1 to FIG. 3 show Examples of the connection filament inserting apparatus of the present invention. FIG. 1 shows an upper view of a connection filament inserting apparatus C of the present invention. FIG. 2 is a cross section of the connection filament inserting apparatus C of the present invention. FIG. 3 is the metal plate 4 before bending the connection filament inserting apparatus to make the hollow body.

First, the metal plate 4 is made to the form shown in FIG. 3. That is, the same mold as the metal plate having the arms-like form is made, wherein the left and right tip edges 12 and 13 of said arm-like form are curved from the tip to the both sides, and the left and right edges 14 and 15, which connect with the end of said edges 12 and 13, is curved toward the inside. Next, the metal plate 4 is punched by the pressing machine having said mold to make a plate for forming. In addition, the whole body of said plate is bent by the pressing to form the hollow body 17, where the T-shape portion 2 of the connection filament 1 made with nylon is inserted, and the arms-like tip edges 12 and a3 are joined and welded to form the front end 11 of the pointed conical portion. When this front end 11 is formed, the hollow body and the edges 14 and 15, where the centers are depressed, are formed together to be the ellipse opening 16 on the upper side of the front part of the hollow body 17. Moreover, the hollow body 17 has the inner space on the joining part of the upper side to be connected with said opening 16, and said inner space is used as the inner space 18 for accommodating the connection filament 1 made with nylon. In addition, the axial portion 21 is fixed at the rear end of the hollow body 17 to attach the equipment machine of the connection filament. Then, the connection filament inserting apparatus is formed. Furthermore, the inside of the pointed conical front end 11 is made to the cavity 19. In addition, since the size of the connection filament 1 itself is varied, the length $L_1$ of the opening is 2 mm to 10 mm longer than the length of the opening 16 of the prior art, for releasing smoothly the T-shape 2 of the connection filament 1 made with nylon, which is inserted to the hollow body 17 to be pushed out from the backside by the pushing rod 4, to the upper out side. Moreover, in order to form the opening 16, the side edges 14 and 15, where the centers are depressed, are formed on the metal plate 4 to form the hollow body. At this time, by depending on how to decide the position of the basal portion [a] and the front end [b] of the edge and how to draw the edge [c] formed between said [a] and [b], the hollow body drawing the parabolic shape or the conical shape can be formed at the time of bending into the hollow. Therefore, the inclined plane is formed at the bottom 20 of the opening 16, by forming the hollow body having the parabolic shape or conical shape. Moreover, it is available that the hollow body is bent up or made an inclined plane having a smoothly curved plane from the near rear end of the opening 16 to the front end 11 of the conical portion. In addition, it is preferably that the angle θ of the inclined plane is in the range of 1° to 15°.

Moreover, the surface of the metal of the connection filament inserting apparatus excepting of its axial part is surface treated by the physical processes, such as the titanium (Ti) coating or the titanium nitride (TiN) coating, or the chemical processes, such as the chromium plating, for the purpose of giving the wear resistance and the fine sight.

The connection filament 1 comprises the stopper portion and the T-shape portion 2, to form an aggregate, where the one part of the stopper portion and one part of rear end of the T-shape portion 2 of the plural connection filaments 1 are temporary-fixed respectively and are equipped in the equipment machine of the connection filament. When the T-shape portion 2 of the connection filament 1 is pushed out in bent state to reach at the position of the opening 16, an elastic force to return the original shape and a force pulling the T-shape portion 2 to the backside, are worked on said T-shape portion 2, where said pulling force is induced because the stopper portion 22 of the rear end of the connection filament 1 equipped in the equipment machine of the connection filament is temporary-fixed in the aggregate, so that the motion going up occurs.

Furthermore, since the inclined plane is formed on the bottom 20 of the opening 16, the action supporting said motion works collectively, so that the T-shape portion 2 of the filament 1 is jumped out up at the same time of reaching at the opening 16. Therefore, there are no accidents, where said T-shape portion 2 is pushed in or caught in the cavity 19.

Regarding the quality of the metal plate 4, a stainless steel is used by considering its machinability and hardenability in the case of Example of the present invention. However, any metals having the excellent machinability and hardenability other than the stainless steel are also available, and it is not necessary to limit the metal material especially.

As mentioned above, the present invention has the following characteristics and advantages. The thin metal plate 4 is formed in the shape of arms, and the hollow body and the front end 11 of the pointed conical portion are formed by a plastic working, and the filler 10 is not filled in the cavity 19 of the front end 11 of the conical portion. Therefore, it becomes possible to do the finishing process, such as the polishing or grinding process, or the physical and chemical surface treatment. In addition, the length L between the standard position at the rear end of the axial portion and the rear end of the opening 16 formed at said front end 10*f* the pointed conical portion, is formed about equivalent or a little longer than the length $L_3$ of said connection filament 1, and the length $L_1$ of said opening 16 is formed in the range of $L_1=L_2+2$ mm to 10 mm, where $L_2$ is the length of the T-shape portion 2. Moreover, the hollow body is formed to connect smoothly to the curve of the conical front end 11, with a parabolic curve narrowing from the near portion of rear end of said opening 16 to the conical front end 11, or the conical hollow body gradually narrowing to the conical front end 11. Or the hollow body is formed with the inclined plane formed at the bottom 20 of the opening 16 by bending into a dogleg or to draw smooth curve at the near portion of the rear end of the opening 16. Therefore, there are no accidents, where the T-shape portion 2 of the connection filament is pushed in or caught in the cavity 19 of the front end 11 of the conical portion. In addition, when the T-shape portion 2 of the connection filament 1 reaches at the opening of the hollow body, the front end of the T-shape portion 2 of the connection filament 1 is given the force jumping out up, so that said T-shape portion 2 can be released speedy and certainly to be attached to the article. Furthermore, since the surface of the metal excepting of the axial portion is surface treated by the physical or chemical processes, the connection filament inserting apparatus can be given with wear resistance, hardness, and fine sight.

[Explanation of Letters or Numerals]

A is a connection filament inserting apparatus of the prior art.

B is a connection filament inserting apparatus of the prior art.

C is a connection filament inserting apparatus of the present invention.

a is a base end of a side edge.

b is a front end of a side edge.

c is a side edge

L is a length between a standard position of an axial portion and a rear end of an opening.

$L_1$ is a length of an opening.

$L_2$ is a length of a T-shape portion of a connection filament.

$L_3$ is a length of a connection filament.

θ is an angle of an inclined plane.
1 is a connection filament.
2 is a T-shape portion of a connection filament
3 is a pushing rod of a T-shape portion of a connection filament.
4 is a metal plate.
5 is an inner space for moving a connection filament.
6 is a tip part in the shape of a spoon of a prior art A.
7 is an opening of a prior art A.
8 is a piercing part.
9 is both side edges at a tip part.
10 is a filler, such as an elastic metal or plastics
11 is a front end of a conical portion.
12 is a left side edge at a front end of a plate 4.
13 is a right side edge at a front end of a plate 4.
14 is a left side edge of a plate 4.
15 is a right side edge of a plate 4.
16 is an opening.
17 is a hollow body.
18 is an inner place for accommodating a connection filament.
19 is a cavity of a front end of a conical portion.
20 is a bottom plane of an opening.
21 is an axial portion.
22 is a stopper portion of a connection filament.

What is claimed is:

1. A combination of a connection filament inserting apparatus for inserting a connection filament through an article and said connection filament, the combination comprising:

a connection filament comprising a T-shaped portion, a stopper portion, and a filament disposed between and connecting said T-shaped portion to said stopper portion, wherein said T-shaped portion has a length $L_2$ and said filament has a length $L_3$, and a hollow body having a front end, a rear end, and an inner space for accommodating said connection filament, said hollow body being formed from a metal plate, said rear end having an axial portion, a pointed conical portion being formed at said front end by pressing, and an ellipse opening for releasing a T-shape portion of said connection filament from said inner space of said body being formed at said pointed conical portion, wherein a length L between a standard position at said rear end of said axial portion and a rear end of said ellipse opening formed at said front end of said pointed conical portion is about equivalent to or a little longer than said length $L_3$, a length $L_1$ of said ellipse opening portion is formed in the range of $L_1=L_2+2$ mm to 10 mm, and said hollow body itself is formed smoothly by connecting a curve from said front end of said pointed conical portion forming a parabolic line gradually narrowed from a near portion of said rear end of said opening to said front end.

2. A combination of a connection filament inserting apparatus for inserting a connection filament through an article and said connection filament, the combination comprising:

a connection filament comprising a T-shaped portion, a stopper portion, and a filament disposed between and connecting said T-shaped portion to said stopper portion, wherein said T-shaped portion has a length $L_2$ and said filament has a length $L_3$, and a hollow body having a front end, a rear end, and an inner space for accommodating said connection filament, said hollow body being formed from a metal plate, said rear end having an axial portion, a pointed conical portion being formed at said front end by pressing, and an ellipse opening for releasing a T-shape portion of said connection filament from said inner space of said body being formed at said pointed conical portion, wherein a length L between a standard position at said rear end of said axial portion and a rear end of said ellipse opening formed at said front end of said pointed conical portion is about equivalent to or a little longer than said length $L_3$, a length $L_1$ of said ellipse opening is formed in the range of $L_1=L_2+2$ mm to 10 mm, and said hollow body itself is formed by smoothly connecting a curve from said front end of said pointed conical portion forming a conical hollow body narrowing from a near portion of said rear end of said opening to said front end.

3. A combination of a connection filament inserting apparatus for inserting a connection filament through an article and said connection filament, the combination comprising:

a connection filament comprising a T-shaped portion, a stopper portion, and a filament disposed between and connecting said T-shaped portion to said stopper portion, wherein said T-shaped portion has a length $L_2$ and said filament has a length $L_3$, and a hollow body having a front end, a rear end, and an inner space for accommodating said connection filament, said hollow body being formed from a metal plate, said rear end having an axial portion, a pointed conical portion being formed at said front end by pressing, and an ellipse opening for releasing a T-shape portion of said connection filament from said inner space of said body being formed at said pointed conical portion, wherein a length L between a standard position at said rear end of said axial portion and a rear end of said ellipse opening formed at said front end of said pointed conical portion is about equivalent to or a little longer than said length $L_3$, a length $L_1$ of said ellipse opening portion is formed in the range of $L_1=L_2+2$ mm to 10 mm, and said hollow body itself is formed to have an inclined plane at a bottom of said opening by bending into a dogleg or to draw a gradual curve from a near portion of said rear end of said opening to said front end.

4. The combination according to any one of claims 1, 2, and 3, wherein an angle θ of the inclined plane from the near portion of said rear end of said opening to the front end is in the range of 1° to 15°.

5. The combination according to any one of claims 1, 2, and 3, wherein the surface of the metal body excepting its axial portion of said apparatus is surface treated by physical or chemical processes.

* * * * *